US006926099B2

(12) United States Patent
Thigpen et al.

(10) Patent No.: US 6,926,099 B2
(45) Date of Patent: Aug. 9, 2005

(54) DRILL OUT BI-CENTER BIT AND METHOD FOR USING SAME

(75) Inventors: Gary M. Thigpen, Kingwood, TX (US); Carl W. Keith, Houston, TX (US)

(73) Assignee: Varel International, L.P., Carrollton, TX (US)

( * ) Notice: Subject to any disclaimer, the term of this patent is extended or adjusted under 35 U.S.C. 154(b) by 45 days.

(21) Appl. No.: 10/397,566

(22) Filed: Mar. 26, 2003

(65) Prior Publication Data

US 2004/0188149 A1 Sep. 30, 2004

(51) Int. Cl.[7] ..... E21B 10/26; E21B 10/40

(52) U.S. Cl. ..... 175/57; 175/391; 175/385; 175/399

(58) Field of Search ..... 175/385, 391, 175/398, 399, 376, 57

(56) References Cited

U.S. PATENT DOCUMENTS

| | | | | |
|---|---|---|---|---|
| 1,326,509 | A | 12/1919 | Humason | |
| 1,454,843 | A | 5/1923 | Brown | |
| 1,519,039 | A | 12/1924 | Morgan et al. | |
| 1,532,330 | A | 4/1925 | Mitchell | |
| 1,587,266 | A | 6/1926 | Zublin | |
| 1,750,628 | A | 3/1930 | Crum | |
| 1,758,773 | A | 5/1930 | Zublin | |
| 1,880,216 | A | 10/1932 | Simmons | |
| 1,896,105 | A | 2/1933 | Simmons | |
| 2,074,951 | A | 3/1937 | Zublin | 255/61 |
| 2,953,354 | A | 9/1960 | Williams, Jr. | 255/61 |
| 3,051,255 | A | 8/1962 | Deely | 175/265 |
| 3,367,422 | A | 2/1968 | Sims | 166/187 |
| 3,367,430 | A | 2/1968 | Rowley | 175/385 |
| 4,064,951 | A | 12/1977 | Weber | 175/45 |
| 4,273,372 | A | 6/1981 | Sheshtawy | 294/86.15 |
| 4,379,494 | A | 4/1983 | Sheshtawy | 175/325 |
| 4,408,669 | A | 10/1983 | Wiredal | 175/258 |
| 4,440,244 | A | 4/1984 | Wiredal | 175/292 |
| 4,589,504 | A | 5/1986 | Simpson | 175/267 |
| 4,635,738 | A | 1/1987 | Schillinger et al. | 175/398 |
| 4,660,657 | A | 4/1987 | Furse et al. | 175/269 |
| 4,751,972 | A | 6/1988 | Jones et al. | 175/329 |
| 4,842,082 | A | 6/1989 | Springer | 175/279 |
| 4,842,083 | A | 6/1989 | Raney | 175/325 |
| 5,040,621 | A | 8/1991 | Löf | 175/258 |
| 5,052,503 | A | 10/1991 | Löf | 175/258 |
| 5,090,480 | A | 2/1992 | Pittard et al. | 166/298 |
| 5,165,494 | A | 11/1992 | Barr | 176/376 |

(Continued)

FOREIGN PATENT DOCUMENTS

| | | | |
|---|---|---|---|
| BE | 1012545 A3 | 12/2000 | E21B/10/62 |
| DE | 28 39 868 | 4/1979 | E21C/19/00 |
| EP | 0 058 061 | 8/1982 | E21B/10/26 |
| EP | 0 712 662 A2 | 5/1996 | B01J/29/04 |
| GB | 218774 | 7/1924 | |
| GB | 2 128 657 A | 5/1984 | E21B/10/32 |
| NL | 8503371 | 12/1985 | E21B/17/10 |
| WO | WO 00/31371 | 6/2000 | E21B/10/32 |
| WO | WO 02/072994 A1 | 9/2002 | E21B/10/32 |

*Primary Examiner*—David Bagnell
*Assistant Examiner*—Shane Bomar
(74) *Attorney, Agent, or Firm*—Baker Botts L.L.P.

(57) ABSTRACT

A drill out bi-center bit and a method for using the same are provided that offer the ability to drill out cement and casing shoes, and increased stability. The bi-center bit includes a bit body having a first end operable to be coupled with a drill string, a second end including a pilot section, and an eccentric reamer section intermediate the first and second ends. A first plurality of cutter assemblies is disposed upon the exterior surface of the pilot section, while a second plurality of cutter assemblies is disposed upon the reamer section. A plurality of recessed cutter assemblies is also disposed upon the pilot section, such that the recessed cutter assemblies are located within a radius beginning at a central axis of the pilot section and terminating at a central axis of the reamer section and are recessed with respect to a lower surface of the pilot.

31 Claims, 5 Drawing Sheets

U.S. PATENT DOCUMENTS

| | | | | | |
|---|---|---|---|---|---|
| 5,311,953 | A | | 5/1994 | Walker | 175/61 |
| 5,368,114 | A | | 11/1994 | Tandberg et al. | 175/267 |
| 5,419,935 | A | | 5/1995 | Butera | 428/35.6 |
| 5,456,312 | A | | 10/1995 | Lynde et al. | 166/55.6 |
| 5,678,644 | A | | 10/1997 | Fielder | 175/391 |
| 5,755,299 | A | | 5/1998 | Langford, Jr. et al. | 175/375 |
| 5,788,000 | A | | 8/1998 | Maury et al. | 175/325.1 |
| 5,911,285 | A | | 6/1999 | Stewart et al. | 175/317 |
| 5,944,129 | A | | 8/1999 | Jensen | 175/430 |
| 6,039,131 | A | * | 3/2000 | Beaton | 175/376 |
| 6,189,631 | B1 | | 2/2001 | Sheshtawy | 175/284 |
| 6,269,893 | B1 | * | 8/2001 | Beaton et al. | 175/391 |
| 6,340,064 | B2 | | 1/2002 | Fielder et al. | 175/385 |
| 6,394,200 | B1 | | 5/2002 | Watson et al. | 175/385 |
| 6,397,958 | B1 | * | 6/2002 | Charles et al. | 175/391 |
| 6,609,580 | B2 | * | 8/2003 | Beaton | 175/406 |
| 6,629,476 | B2 | * | 10/2003 | Fielder et al. | 76/108.2 |

* cited by examiner 53
50
56
57
52
57
58
58
51
55

DRILL OUT BI-CENTER BIT AND METHOD FOR USING SAME

TECHNICAL FIELD OF THE INVENTION

The present invention relates in general to the field of oil and gas drilling and, in particular, to a drill out bi-center bit and a method for using the same.

BACKGROUND OF THE INVENTION

When drilling through subterranean formations in the exploration for oil and gas, it is common practice to drill larger diameter holes at the surface, and successively smaller diameter holes as the well is drilled deeper, cementing tubular casings in place at various depths along the well bore. It is often desirable, however, to drill a hole larger than the inside diameter of the last casing that was set, at some known depth below the surface. Since conventional drill bits large enough to generate the desired well bore diameter will not fit inside the casing that has already been set, special tools are used to drill a well bore larger in diameter than the inside diameter of the casing. One such tool used for this purpose is a bi-center bit.

A bi-center bit is an undersized drill bit with a large eccentric cutting structure located off-center above a smaller pilot drill bit that is centered axially with the drill collars. The bi-center bit is sized so that while being run into the hole, the pilot bit is pushed to one side to allow the tool to pass through the inside of the casing. Once at the bottom of the hole, though, the pilot bit then acts as a centered pivot point for the eccentric cutting structure above, which generates a hole larger in diameter than the inside diameter of the casing through which it passed.

Despite their widespread use, many bi-center bits suffer from one or more limitations. One such limitation is the inability of many bi-center bits to drill out cement or casing shoes. This is due to the fact that when the bit is inside a casing, the pilot section of the bit tends to rotate around the center of the drill string, causing the gauge cutters to engage the casing. This damages both the cutters and the casing. Additionally, since the center of the pilot bit is aligned with the drill string, the bit also tends to rotate off-center when inside the casing. This can cause damage to the cutters on the leading face of the bi-center drill bit. The extent of this damage may be further increased when a directional drilling bottom hole assembly is attached to the drill string just above the bit.

Another limitation of many bi-center bits is that cutters placed in the center of the bit may rotate backward (i.e., opposite their cutting faces) when the bit is inside a casing. This backward rotation prevents efficient cutting action, and when the cutters contact the casing, may result in damage to the cutters.

SUMMARY OF THE INVENTION

In accordance with the present invention, a drill out bi-center bit and a method for using the same are provided that offer the ability to drill out cement and casing shoes, and increased stability. The bi-center bit comprises a bit body having a first end operable to be coupled with a drill string, a second end including a pilot section, and an eccentric reamer section intermediate the first and second ends. A first plurality of cutter assemblies is disposed upon the exterior surface of both the pilot section, while a second plurality of cutter assemblies is disposed upon the reamer section. A plurality of recessed cutter assemblies is also disposed upon the pilot section, such that the recessed cutter assemblies are located within a radius beginning at a central axis of the pilot section and terminating at a central axis of the reamer section and are recessed with respect to a lower surface of the pilot.

Technical advantages of particular embodiments of the present invention include a bi-center drill bit having the ability to drill out cement and casing shoes. This eliminates the need to drill out the cement and casing shoe with a drill bit prior to the insertion of the bi-center bit, reducing expenses and total drilling time.

Another technical advantage of particular embodiments of the present invention is a bi-center drill bit that does not require specialized center cutters that can only be used in the drill out mode. Because of this, the center cutters of the bi-center bit may be placed more efficiently, allowing a better utilization of the center cutters.

Yet another technical advantage of particular embodiments of the present invention is that it allows many choices of bit profile, as long as the cutters outside the casing centerline precede the center cutters in the cement drilling, or drill-out, operation. This allows a designer to select bit profiles to better suit drilling conditions.

Other technical advantages will be readily apparent to one skilled in the art from the following figures, descriptions, and claims. Moreover, while specific advantages have been enumerated above, various embodiments may include all, some, or none of the enumerated advantages.

BRIEF DESCRIPTION OF THE DRAWINGS

For a more complete understanding of the present invention and its advantages, reference is now made to the following descriptions, taken in conjunction with the accompanying drawings, in which.

DETAILED DESCRIPTION OF THE INVENTION

Figure 1:
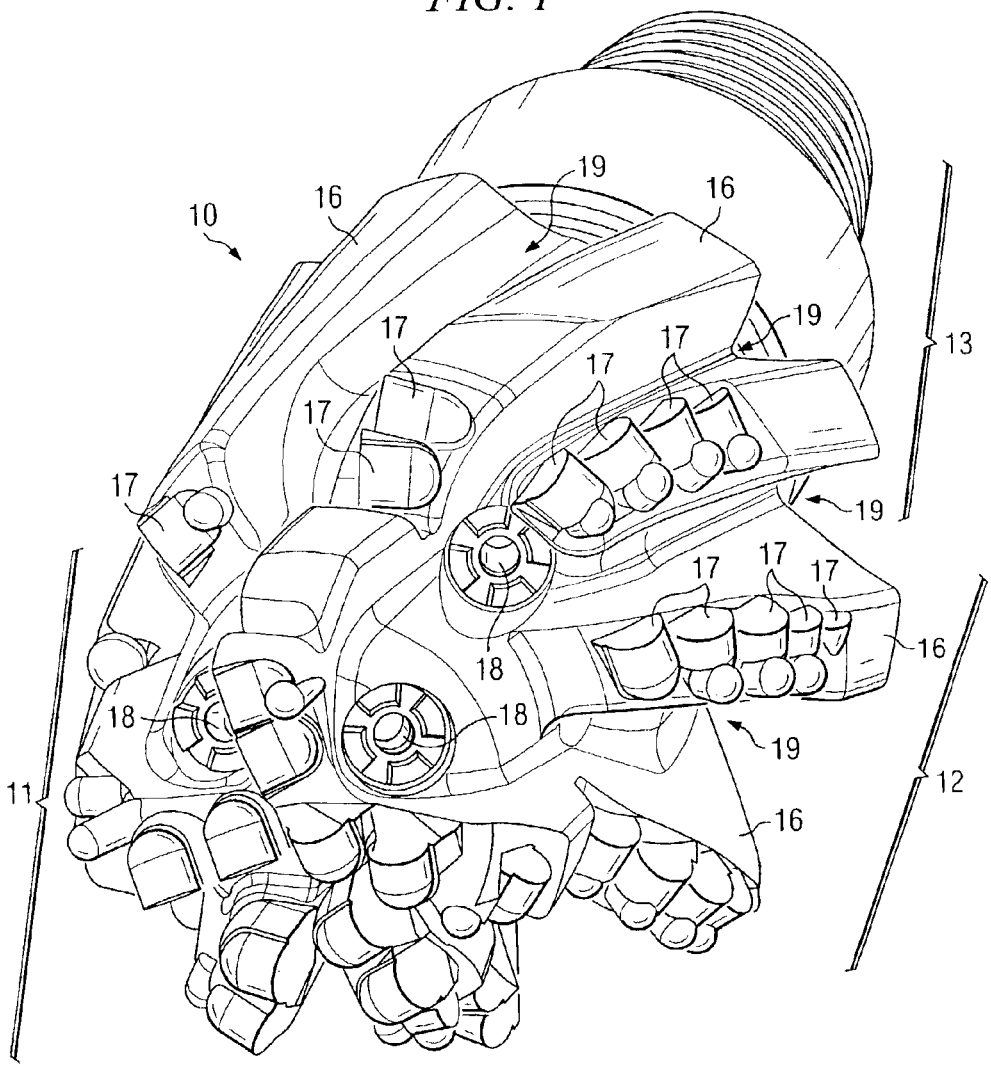
FIG. 1 illustrates an isometric view of a bi-center bit having a recessed area on its pilot section in accordance with a particular embodiment of the present invention.

FIG. 1 illustrates an isometric view of bi-center bit 10 in accordance with a particular embodiment of the present invention. Bi-center bit 10 is a drill bit used for drilling bore holes into the earth for mineral, oil, and/or gas recovery. In particular, bi-center bit 10 is a bi-center drill bit designed to drill out the cement and other material inside a casing. After drilling out the cement and other material, the bi-center bit 10 drills a full bore hole with a diameter greater than the inner diameter of the casing(s) through which it passed. In accordance with a particular embodiment, bi-center bit 10 is configured with non-drilling bearing elements that contact the casing when the bit is drilling the cement, and prevent the gauge cutting elements of bi-center bit 10 from contacting the casing. Bi-center bit 10 also includes a recessed area on the center of the pilot section that prevents reverse scraping of the cutting elements when drilling both the cement and the formation.

As shown in FIG. 1, bi-center bit 10 includes a generally elongate bit body having a pilot section 11 disposed at its first end and a threaded region 13, adapted to receive a drill string or other well tool, disposed at its second end. Bi-center bit 10 may be constructed of a mild steel core attached to a steel shank, with a body made of tungsten carbide matrix with a copper alloy binder. However, it should be recognized that bi-center bit 10 may be constructed using one or more of a variety of materials. When bi-center bit 10 is disposed within a well, it is oriented such that pilot section 11 is down-hole from threaded region 13. In this installed position, threaded region 13 is coupled with a drill string such that bi-center bit 10 is in fluid communication with the drill string during drilling operation.

Intermediate the pilot section 11 and threaded region 13 is eccentric reamer section 12. Reamer section 12 is positioned above and off-center from pilot section 11. During drill-out of a casing, reamer section 12 rotates about a central axis that coincides with the central axis of the casing. This central axis is offset from the central axis of the pilot section. For purposes of this specification, the central axis of the casing may be referred to as the central axis of the reamer section 12.

The pilot section 11, reamer section 12, and threaded end 13 of bi-center bit 10 are configured so that while being run into a well bore, pilot section 11 is pushed to one side to allow the bit 10 to pass through the inside of the casing. Once bi-center bit 10 is through the casing or well bore, pilot section 11 then acts as a centered pivot point for eccentric reamer section 12 above it. During operation, reamer section 12 pivots generally around a central axis of pilot bit 11, generating a hole larger in diameter than the inside diameter of the casing through which it passed.

Disposed on pilot section 11 and reamer section 12 are a plurality of ribs 16. On each of these ribs 16, a plurality of cutter assemblies 17 are disposed. These cutter assemblies 17 include cutting elements made from polycrystalline diamond compact (PDC) or other suitable materials, which may brazed to the tungsten carbide bit body. Disposed between the ribs 16 are a plurality of grooves or flutes 19. These grooves or flutes 19 accommodate the flow of drilling fluid, water, and/or debris up-hole from bi-center bit 10 during operation.

Bi-center bit 10 also includes a number of circulation ports or nozzles 18 located near its central axis. These nozzles 18 connect with the center of the bit body and distribute the above-mentioned drilling fluid, which is pumped down the drill string, into the bit body, and out into the well bore.

Figure 2:
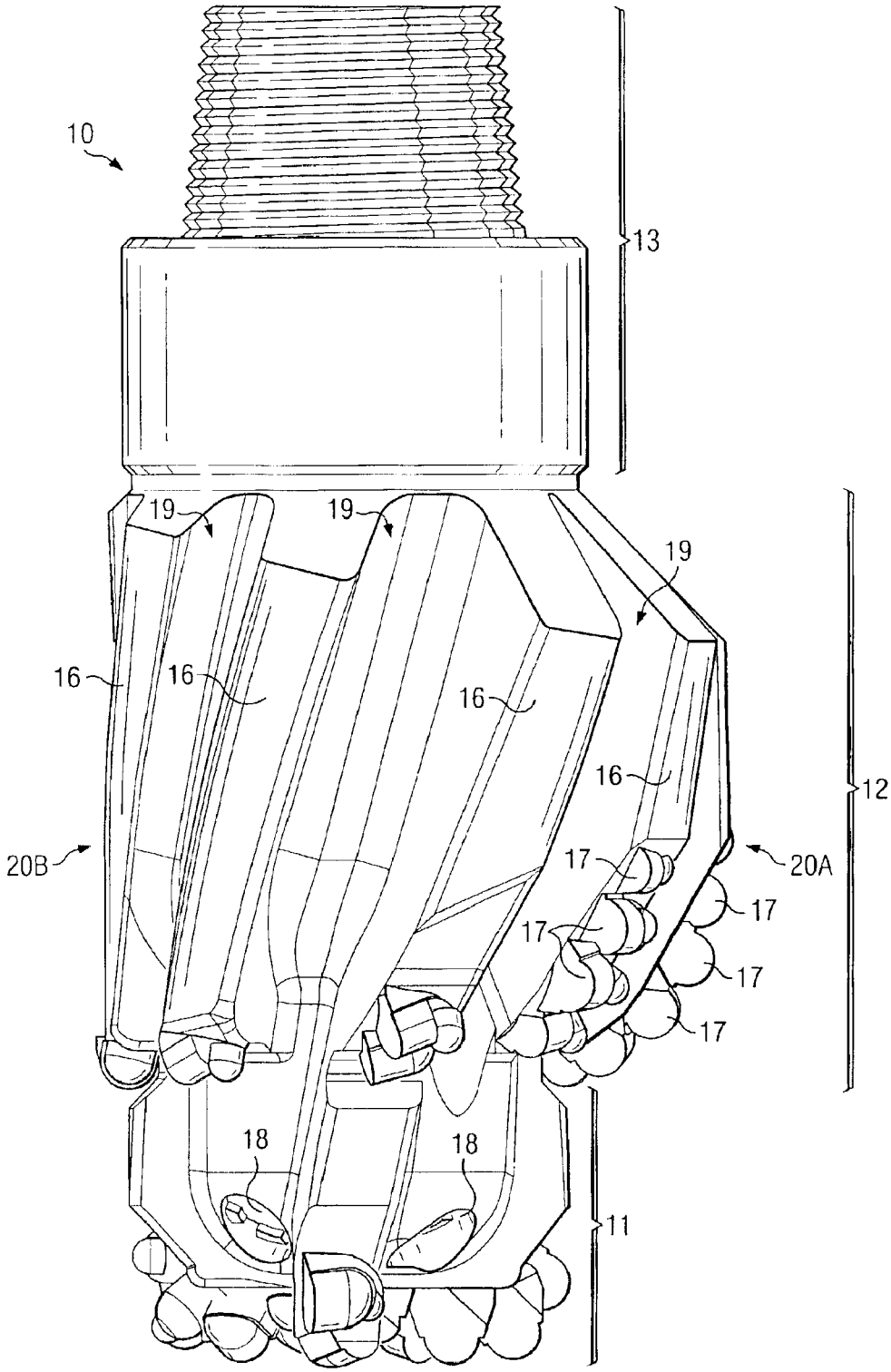
FIG. 2 illustrates a side view of the bi-center bit shown in FIG. 1.

FIG. 2 illustrates a side view of bi-center bit 10 as it would be oriented in a well bore. In this orientation, pilot section 11 is located down-hole from threaded region 13. As can be seen more clearly in this figure, the ribs 16 on reamer section 12 extend further out from the central, longitudinal axis of the bit body on one side, side 20A, of the reamer than the other, side 20B. As mentioned above, when bi-center bit 10 is operated in full-hole mode, reamer section 12 pivots generally around a central axis of pilot section 11. In this mode, side 20A, also known as the full-hole gauge contact region, comes in contact with the wall of the well bore and may be used to enlarge the diameter of the well bore.

Before the bi-center bit can be used to enlarge the diameter of a well bore, though, it must first pass through a casing. When a typical bi-center bit is rotated in a casing, the bit is constrained such that it must rotate about the center of the casing rather than the center of the drill string. If the bit rides smoothly on the casing wall, some cutter assemblies in the center of the pilot section rotate in the opposite direction of their cutting face. This type of rotation can damage the cutters due to reverse scraping. However, if the bit does not ride smoothly on the casing, the outer cutters and casing can also be damaged. Once through the casing, the bi-center bit is no longer constrained by the casing and is free to rotate about the central axis of the pilot section, which is typically coaxial with the central axis of the drill string.

Due to the many problems associated with using a bi-center bit to drill out, particular embodiments of the present invention incorporate several design features aimed at preventing and/or alleviating these problems. One such design feature is the incorporation of a recessed area of the tip of the pilot section, so that the cutter assemblies within that region are prevented from being damaged due to any reverse scraping that might occur during drill-out. An example of such a bi-center bit having a recessed area in the pilot is shown in FIGS. 3 and 4.

Figure 3:
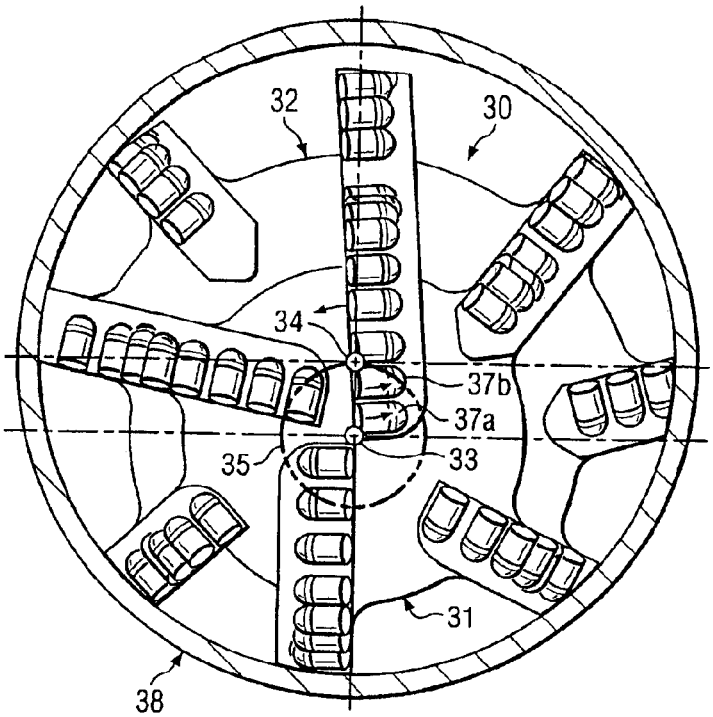
FIG. 3 illustrates a face view of a bi-center bit having a recessed area on its pilot section, as it would be positioned within a casing.
Figure 4:
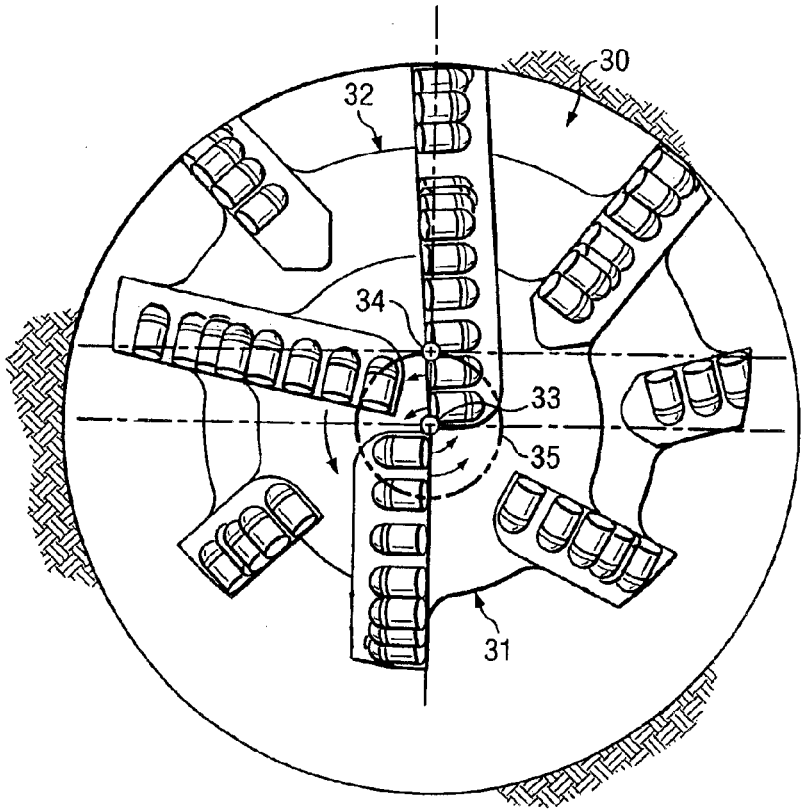
FIG. 4 illustrates a face view of the bi-center bit shown in FIG. 3 as it would be positioned during hole enlargement.

FIGS. 3 and 4 illustrate face views of bi-center bit 30 in accordance with a particular embodiment of the present invention. Bi-center bit 30, similar to other bi-center bits, typically rotates around one of two centers of rotation: central axis 33 of the pilot section 31, or second central axis 34 of the reamer section 32.

In FIG. 3, bi-center bit 30 is shown as it would be used to drill out a casing 38. In this drill out mode, bi-center bit 30 rotates around central axis 34 of reamer section 32. As shown by the directional arrows, in this illustration bi-center bit 30 rotates counter-clockwise when viewed from below. Due to this rotation about the central axis 34 of the reamer section 32, some of the cutters on pilot section 31 (illustrated by cutters 37*a* and 37*b*) rotate opposite the normal cutting direction of the cutters (i.e., opposite the direction of their cutting faces). On a typical bi-center bit, this backward rotation of the cutters would result in excessive wear and damage to the cutters due to reverse scraping. To prevent this damage, all the cutters within recessed area 35, which is a circular area centered at central axis 33 of pilot section 31 and extending to central axis 34 of reamer section 32, are recessed with respect to a lower surface of pilot section 31. In other words, they are recessed into the tip of pilot section 31. Due to the fact that they are recessed into pilot section 31, the cutters within recessed area 35 are prevented from coming in contact with the material to be drilled when bi-center bit 30 is used to drill out a casing. Because of this, there is less likelihood of the cutters being damaged or drilling operations being slowed due to the backward rotation of the cutters.

After passing through the casing, bi-center bit 30 may be used to enlarge a well bore. FIG. 4 illustrates bi-center bit 30 as it would be used for such a full-hole operation. During full-hole operations, bi-center bit 30 still rotates counter-clockwise; however, bi-center bit 30 now rotates around central axis 33 of pilot section 31 (rather than central axis 34 of reamer section 32). As shown by the directional arrows, unlike drill-out operation, during full-hole operation all of the cutters on bi-center bit 30 rotate with their cutting faces forward, even those cutters that are recessed into area 35 on the pilot section 31. Because of this forward rotation, the cutters within area 35 may be used for cutting during full-hole operation, even though they were prevented from cutting during drill-out. This ability to use the recessed cutters in full-hole operation is yet another advantage of particular embodiments of the present invention.

Figure 5:
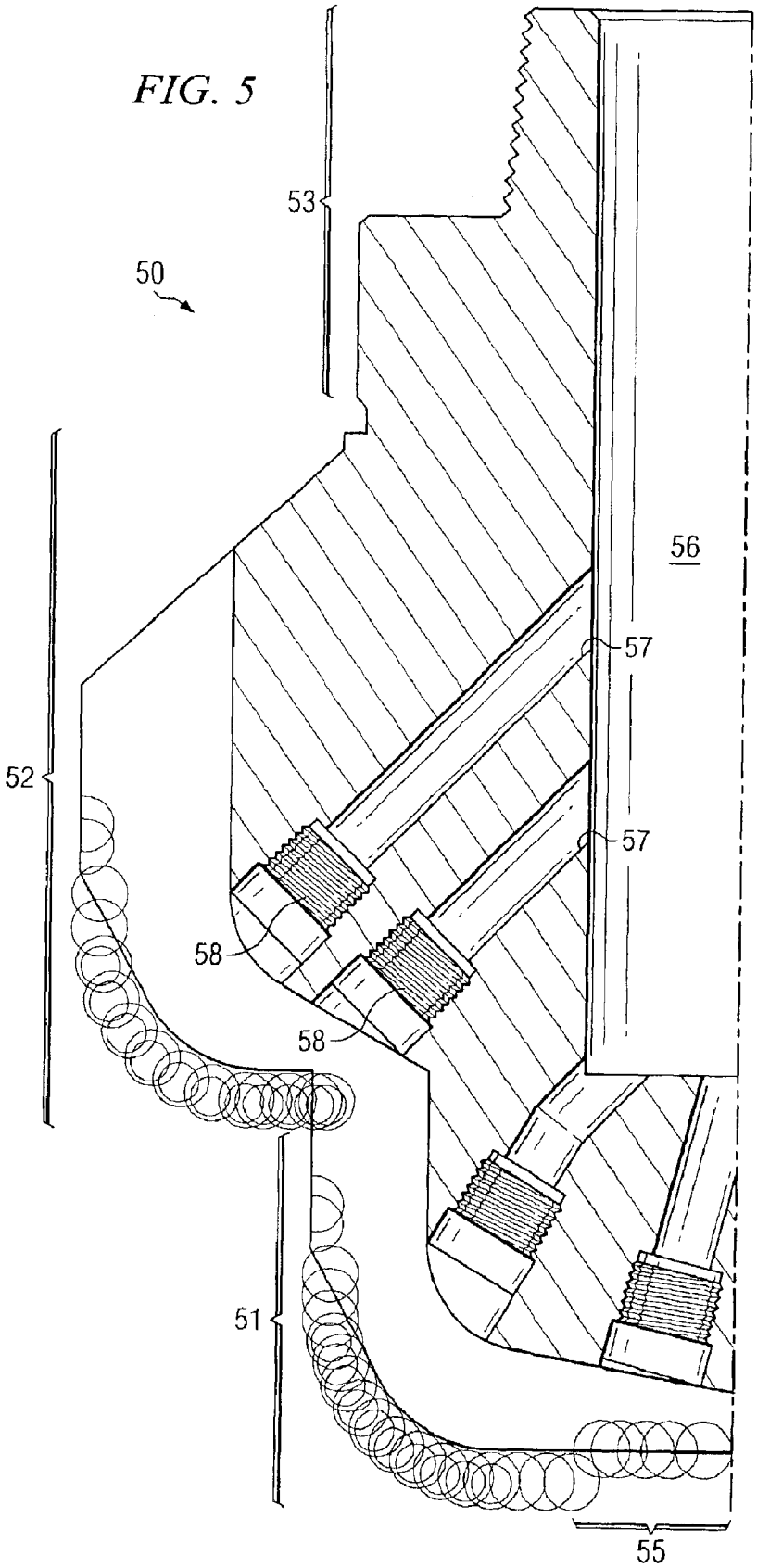
FIG. 5 illustrates a cut-away side view of a bi-center bit having a recessed area on its pilot section.

Another view of a recessed area employed in particular embodiments of the present invention is shown in FIG. 5. FIG. 5 illustrates a cut-away side view of bi-center bit 50 in accordance with a particular embodiment of the present invention. Similar to the previously discussed bi-center bits, bi-center bit 50 includes pilot section 51, reamer section 52, and threaded section 53. Disposed in the center of bi-center bit 50 is cavity 56, which is in fluid communication with the drill string attached to threaded section 53. Cavity 56 feeds into a plurality of shafts 57, which connect to nozzles 58 on the exterior surface of bi-center bit 50. These nozzles 58 direct the drilling fluid that is pumped down the drill string out of bi-center bit 50.

Bi-center bit 50 also includes recessed area 55. Like the previously discussed recessed areas, recessed area 55 is recessed into pilot section 51, so that none of the cutters within area 55 come in contact with the surface of a casing that is being drilled out. These cutters are positioned on pilot section 51 so that when bi-center bit 50 is rotated inside the casing, the bit has a complete cutter profile from the centerline of the casing. Since the cutters in the center of pilot section 51 are in a recess, they follow the drilling operation of the cutters outside the recess. As the cutters outside the casing centerline precede the cutters within the recess, the cement of the casing is removed before it can contact the center cutters and potentially damage them.

Other than being recessed into pilot section 51, the cutters in recessed area 55 may otherwise be placed in a normal fashion. Although these cutters move in the reverse direction, they do not touch the material to be drilled during a drill-out operation. Since the recessed cutters do not touch the material to be drilled, they cannot be damaged or slow drilling operations.

Furthermore, although area 55 is shown as a flat, recessed area, other embodiments of the present invention could feature recessed areas of other shapes, including that of a cone. Such a cone-shaped, or conical, area at the center of the pilot may aid in the stability of the bit and prevent impact damages when the bi-center bit is used in full-hole mode. Other shapes, both convex and concave, are also possible. All that is common to these embodiments is that the cutters outside the casing centerline precede the cutters within the recess. Because of this, particular embodiments of the present invention provide bit designers with added flexibility in choosing a particular profile for a bit.

As previously mentioned, recessing the cutters at the center of the pilot section of the bi-center bit offers numerous technical advantages, including preventing and/or alleviating reverse scraping of the cutter assemblies. Additionally, bi-center bits such as those described above can typically feature more functional cutters than bi-center bits that feature a cutter-devoid area at the center of their pilot sections. This allows bit designers more flexibility in choosing the number of cutters to employ in a given design. Furthermore, bi-center bits in accordance with particular embodiments of the present invention also offer the advantage of not having to rely on specialized cutters that can be used only during drill-out mode. This allows the center cutters of the bi-center bit to be placed more efficiently, allowing better utilization of the center cutters.

In addition to having a recessed area at the center of their pilot sections, particular embodiments of the present invention may incorporate features designed to minimize the damage to a casing when the bi-center bit is used in drill-out mode. One such embodiment is shown in FIG. 6.

Figure 6:
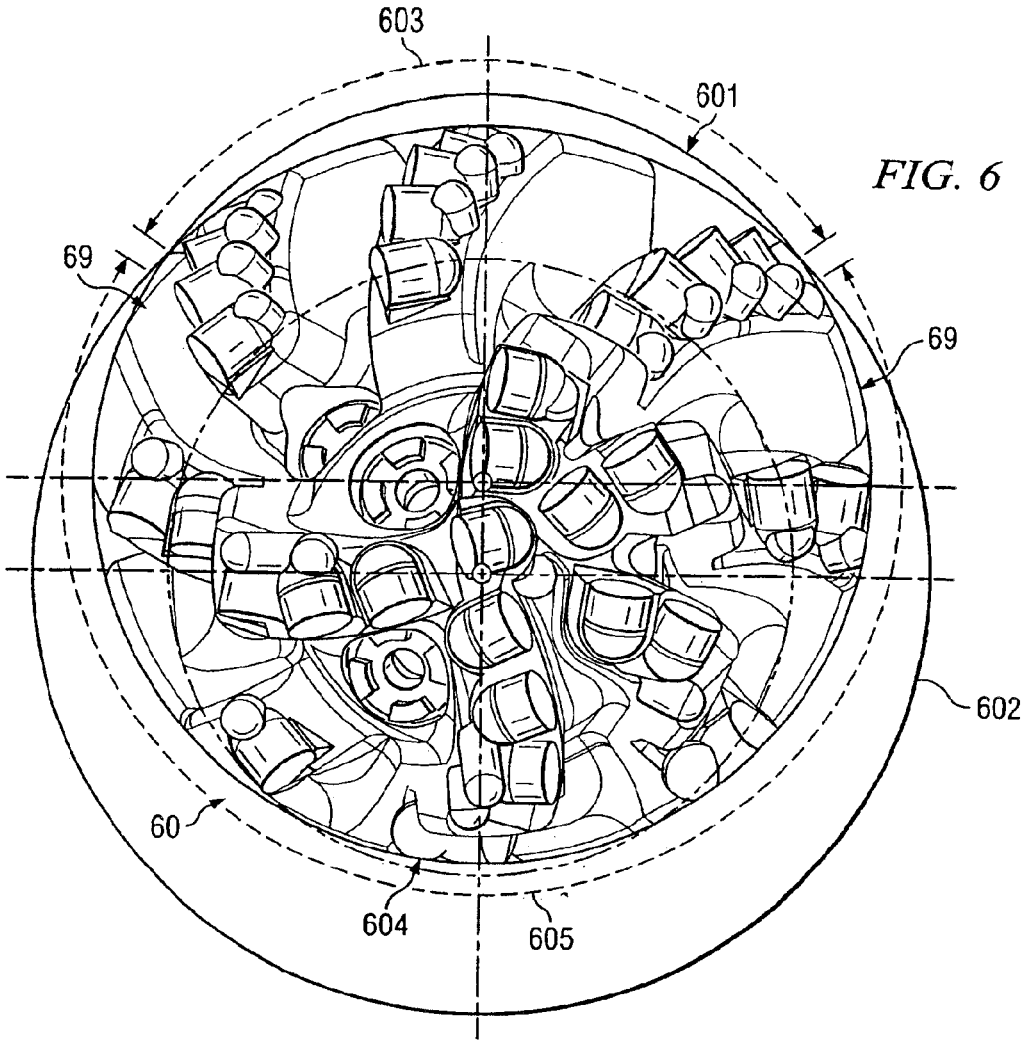
FIG. 6 illustrates a face view of a bi-center bit having smooth bearing areas and depth of cut limiters on its reamer section.

FIG. 6 illustrates a face view of a bi-center bit 60 in accordance with a particular embodiment of the present invention. Bi-center bit 60 incorporates both smooth bearing areas 69 and depth of cut, or penetration, limiters 604, which may be used to prevent or reduce the damage inflicted upon a casing during drill-out mode. In FIG. 6, bi-center bit 60 is shown inside casing inner circumference 601 and full-hole circumference 602. In this illustration, circumference 601 represents the inner circumference of a casing bi-center bit 60 would pass through during drill-out operation, whereas circumference 602 represents the circumference of a hole that would be cut by bi-center bit 60 in full-hole mode.

Normal practice in bi-center bit design is to design the reamer section so that it has several gauge contact points. Having more gauge contact points provides more positions for cutting elements on the gauge. This allows the reamer to have more durability and hold the correct gauge diameter. In FIG. 6, this region of gauge contact is shown by full-hole gauge contact region 603.

Because of the geometry of bi-center bit 60 and circumferences 601 and 602, when bi-center bit 60 passes through a casing, full-hole gauge contact region 603 is not in contact with the casing (i.e., circumference 601). Instead, smooth, non-cutting bearing areas 69 are placed just outside region 603, so that when bi-center bit 60 is operated in drill-out mode, the smooth bearing areas 69 ride on the casing. This prevents the full-hole gauge cutting elements from contacting the casing wall and allows bi-center bit 60 to ride smoothly on a casing wall. As full-hole gauge contact region 603 is prevented from contacting the casing, the region can be designed with full-hole gauge cutting elements without regard to how the elements might engage a casing.

However, while full-hole contact region 603 is prevented from contacting the inside of the casing, the side 605 of bi-center bit 60 opposite full-hole gauge contact region 603 is not. Therefore, the gauge cutting elements on this side 605 of bi-center bit 60 must be prevented from cutting the casing when they come in contact with it. To accomplish this, bi-center bit 60 includes depth of cut limiters 604. Depth of cut limiters 604, also known as penetration limiters, are designed to prevent the gauge cutting elements from cutting the inside wall of a casing, while allowing the cutting elements to cut in the downward direction. An example of such a depth of cutter limiter employed in particular embodiments of the present invention is shown in FIGS. 7–9.

Figure 7:
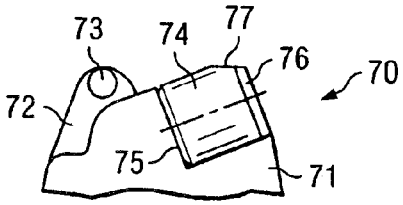
FIG. 7 illustrates a side view of a depth of cut limiter employed in a particular embodiment of a bi-center bit.
Figure 8:
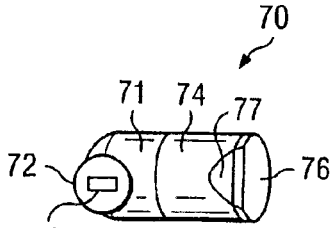
FIG. 8 illustrates a top view of the depth of cut limiter shown in FIG. 7.

FIG. 7 illustrates a side view of the depth of cut limiter 70. Depth of cut limiter 70 includes cutting element 74 coupled to cutter assembly 71. Typically, cutting element 74 is constructed out of tungsten carbide, or another suitable material, and is brazed to cutter assembly 71 along braze surface 75. On its cutting face, cutting element 74 includes cutting surface 76, which is typically PDC. Depth of cut limiter 70 also features a beveled gauge grind surface 77 on the edge of cutter element 74. Gauge grind surface 77 is designed to come in contact with the gauge surface of a casing and ride smoothly inside the casing without cutting it.

Depth of cut limiter 70 also features bump 72, which allows depth of cut limiter 70 to cut in the downward direction. Typically constructed of the same material as cutter assembly 71 and the rest of the bit body (not shown in this illustration), bump 72 trails behind cutting element 74 when the bi-center bit is rotated in the forward direction and features round cutting element 73. Round cutting element 73 is typically constructed of spherical or cylindrical diamond, thermally stable polycrystalline (TSP), or another relatively less aggressive cutting element, and is designed to allow depth of cut limiter 70 to cut in the downward direction, even though it is prevented from cutting into a casing. Another view of depth of cut limiter 70 is shown in FIG. 8, which illustrates a side view of depth of cut limiter 70.

Figure 9:
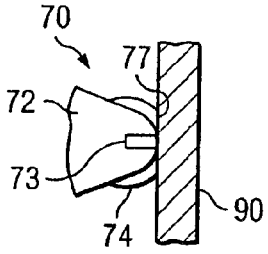
FIG. 9 illustrates a front view of the depth of cut limiter shown in FIG. 7, in contact with a casing wall.

FIG. 9 shows another view of depth of cut limiter 70. In this example depth of cut limiter 70 is shown riding on the wall 90 of a well casing. In this orientation, gauge grind surface 77 rides smoothly on casing wall 90, while round cutting element 73 trails behind. Because of this, depth of cut limiter 70 is prevented from cutting into the wall of the casing, but is operable to cut in the down-hole direction and assist in material removal. This assists in minimizing the damage to both the casing and the cutters, and allows the cutters in region 605 to ride smoothly on the casing wall.

Although preferred embodiments of the method and apparatus of the present invention have been illustrated in the accompanying drawings and described in the foregoing detailed description, it will be understood that the invention is not limited to the embodiment disclosed, but is capable of numerous rearrangements, modifications, and substitutions without departing from the spirit of the invention as set forth and defined by the following claims.

What is claimed is:

1. A bi-center bit, comprising:

a bit body having a first end configured to be coupled with a drill string, a second end including a pilot section, and an eccentric reamer section intermediate the first and second ends;

a first plurality of exposed cutter assemblies disposed upon an exterior surface of the pilot section;

a second plurality of exposed cutter assemblies disposed upon an exterior surface of the reamer section;

a plurality of recessed cutter assemblies disposed upon the exterior surface of the pilot section;

wherein the recessed cutter assemblies are located within a radius beginning at a central axis of the pilot section and terminating at a central axis of the reamer section and are recessed with respect to a lower surface of the pilot section; and wherein at least one of the first plurality of exposed cutter assemblies is disposed outside of the radius and abuts the radius at the central axis of the reamer section such that the at least one of the first plurality of exposed cutter assemblies precedes the recessed cutter assemblies when the bit body is rotated around the central axis of the reamer section.

2. The bi-center bit of claim 1, wherein the central axis of the pilot section is coaxial with a longitudinal axis of the bit body.

3. The bi-center bit of claim 1, wherein the recessed cutter assemblies are configured in a generally flat shape.

4. The bi-center bit of claim 1, wherein the recessed cutter assemblies are configured in a generally conical shape.

5. The bi-center bit of claim 1, wherein the recessed cutter assemblies are configured in a generally concave shape.

6. The bi-center bit of claim 1, wherein the recessed cutter assemblies are configured in a generally convex shape.

7. The bi-center bit of claim 1, wherein the exposed cutter assemblies include polycrystalline diamond compact cutting elements.

8. The bi-center bit of claim 1, wherein the recessed cutter assemblies include polycrystalline diamond compact cutting elements.

9. The bi-center bit of claim 1, further comprising:

a plurality of smooth bearing elements positioned on an exterior surface of the reamer section outside of a full-hole gauge contact region;

wherein the smooth bearing elements are operable to ride on a casing wall without cutting into the casing wall; and wherein the smooth bearing elements are operable to prevent the full-hole gauge contact region from contacting the casing wall.

10. The bi-center bit of claim 9, further comprising:

a plurality of depth of cut limiters disposed on the exterior surface of the reamer section outside the full-hole gauge contact region; and wherein the depth of cut limiters are operable to cut in a down-hole direction without cutting into the casing wall.

11. The bi-center bit of claim 10, wherein each depth of cut limiter includes a beveled gauge grind surface operable to ride along the casing wall.

12. The bi-center bit of claim 11, wherein each depth of cut limiter includes a raised section adjacent to and behind the gauge grind surface.

13. The bi-center bit of claim 12, wherein the raised section includes a spherical or cylindrical diamond cutting element.

14. The bi-center bit of claim 13, wherein the raised section includes a spherical or cylindrical thermally stable polycrystalline cutting element.

15. The bi-center bit of claim 10, wherein the depth of cut limiters include polycrystalline diamond compact cutting elements.

16. A bi-center bit, comprising:

a bit body having a first end operable to be coupled with a drill string, a second end including a pilot section, and an eccentric reamer section intermediate the first and second ends;

a first plurality of exposed cutter assemblies disposed upon an exterior surface of the pilot section;

a second plurality of exposed cutter assemblies disposed upon an exterior surface of the reamer section;

a plurality of smooth bearing elements positioned on an exterior surface of the reamer section outside of a full-hole gauge contact region;

wherein the smooth bearing elements are operable to ride on a casing wall without cutting into the casing wall;

wherein the smooth bearing elements are operable to prevent the full-hole gauge contact region from contacting the casing wall;

a plurality of depth of cut limiters disposed on the exterior surface of the reamer section outside the full-hole gauge contact region;

wherein the depth of cut limiters are operable to cut in a down-hole direction without cutting into the casing wall;

wherein each depth of cut limiter includes a beveled gauge grind surface operable to ride along the casing wall; and wherein each depth of cut limiter includes a raised section adjacent to and behind the gauge grind surface.

17. The bi-center bit of claim 16, wherein the raised section includes a spherical or cylindrical diamond cutting elements.

18. The bi-center bit of claim 16, wherein the raised section includes a spherical or cylindrical thermally stable polycrystalline cutting elements.

19. The bi-center bit of claim 16, wherein the depth of cut limiters include polycrystalline diamond compact cutting elements.

20. A method for reducing reverse scraping of cutter assemblies of a bi-center bit, comprising:

disposing a first plurality of exposed cutter assemblies on an exterior surface of a pilot section of a bit body, the bit body having a first end operable to be coupled with a drill string, a second end including the pilot section, and an eccentric reamer section intermediate the first and second ends;

disposing a second plurality of exposed cutter assemblies upon an exterior surface of the reamer section;

disposing a plurality of recessed cutter assemblies upon the pilot section;

recessing, with respect to a lower surface of the pilot section, the recessed cutter assemblies located on the pilot section within a radius beginning at a central axis of the pilot section and terminating at a central axis of the reamer section; and wherein at least one of the first plurality of exposed cutter assemblies is disposed outside of the radius and abuts the radius at the central axis of the reamer section such that the at least one of the first plurality of exposed cutter assemblies precedes the recessed cutter assemblies when the bit body is rotated around the central axis of the reamer section.

21. The method of claim 20, wherein the central axis of the pilot section is coaxial with a longitudinal axis of he bit body.

22. The method of claim 20, further comprising configuring the recessed cutter assemblies in a generally flat shape.

23. The method of claim 20, further comprising configuring the recessed cutter assemblies in a generally conical shape.

24. The method of claim 20, further comprising configuring the recessed cutter assemblies in a generally concave shape.

25. The method of claim 20, further comprising configuring the recessed cutter assemblies in a generally convex shape.

26. The method of claim 20, further comprising:

disposing a plurality of smooth bearing elements upon the exterior surface of the reamer section outside of a full-hole contact region;

wherein the smooth bearing elements are operable to ride on a casing wall without cutting the casing wall; and wherein the smooth bearing elements are operable to prevent the full-hole gauge contact region from contacting the casing wall.

27. The method of claim 26, further comprising:

disposing a plurality of depth of cut limiters on the exterior surface of the reamer section outside of the full-hole gauge contact region;

wherein the depth of cut limiters are operable to cut in a down-hole direction without cutting into the casing wall.

28. A method for enhancing the stability of a bi-center bit, comprising:

disposing a first plurality of exposed cutter assemblies on an exterior surface of a pilot section of a bit body, the bit body having a first end operable to be coupled with a drill string, a second end including the pilot section, and an eccentric reamer section intermediate the first and second ends;

disposing a second plurality of exposed cutter assemblies upon an exterior surface of the reamer section;

disposing a plurality of smooth bearing elements upon the exterior surface of the reamer section outside of a full-hole gauge contact region;

wherein the smooth bearing elements are operable to ride on a casing wall without cutting the casing wall;

wherein the smooth bearing elements are operable to prevent the full-hole gauge contact region from contacting the casing wall;

disposing a plurality of depth of cut limiters on the exterior surface of the reamer section outside the full-hole gauge contact region;

wherein the depth of cut limiters are operable to cut in a down-hole direction without cutting into the casing wall;

wherein each depth of cut limiter includes a beveled gauge grind surface operable to ride along the casing wall; and wherein each depth of cut limiter includes a raised section adjacent to and behind the gauge grind surface.

29. The method of claim 28, wherein the raised section includes a spherical or cylindrical diamond cutting element.

30. The method of claim 28, wherein the raised section includes a spherical or cylindrical thermally stable polycrystalline cutting element.

31. The method of claim 28, wherein the depth of cut limiters include polycrystalline diamond compact cutting elements.

* * * * *